US006523765B1

(12) United States Patent
Kurenuma et al.

(10) Patent No.: US 6,523,765 B1
(45) Date of Patent: Feb. 25, 2003

(54) AUTOMATICALLY OPERATED SHOVEL AND STONE CRUSHING SYSTEM COMPRISING THE SAME

(75) Inventors: Toru Kurenuma, Tsuchiura (JP); Akira Hashimoto, Tsuchiura (JP); Kazuhiro Sugawara, Ibaraki (JP); Yoshiyuki Nagano, Ibaraki (JP); Hideto Ishibashi, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/424,061

(22) PCT Filed: Mar. 18, 1999

(86) PCT No.: PCT/JP99/01393

§ 371 (c)(1),
(2), (4) Date: Nov. 18, 1999

(87) PCT Pub. No.: WO99/47759

PCT Pub. Date: Sep. 23, 1999

(30) Foreign Application Priority Data

Mar. 18, 1998 (JP) ..... 10-068733
Jul. 6, 1998 (JP) ..... 10-190806

(51) Int. Cl.[7] ..... B02C 19/00
(52) U.S. Cl. ..... 241/30; 241/101.2; 241/101.5
(58) Field of Search ..... 405/303; 241/101.2, 241/101.5, 30

(56) References Cited

FOREIGN PATENT DOCUMENTS

| | | |
|---|---|---|
| JP | 57-81203 | 11/1980 |
| JP | 56-153026 | * 11/1981 |
| JP | 57-51338 | 3/1982 |
| JP | 2-101229 | 4/1990 |
| JP | 4-126914 | 4/1992 |
| JP | 6-26213 | * 2/1994 |
| JP | 9-66244 | 3/1997 |
| JP | 9-88355 | 3/1997 |
| JP | 9-195321 | 7/1997 |
| JP | 10-212740 | 8/1998 |

* cited by examiner

*Primary Examiner*—Mark Rosenbaum
(74) *Attorney, Agent, or Firm*—Crowell & Moring LLP

(57) ABSTRACT

An automatically operated shovel, which includes a power shovel and an automatic operation controller 50 for making the power shovel reproduce a series of taught operations ranging from digging to dumping, is characterized in that the automatic operation controller is provided with a positioning determination means 511 for determining whether or not the power shovel has reached within a taught position range predetermined based on corresponding one of positioning accuracies set for individual taught positions of said power shovel, and, when the power shovel is determined to have reached within the predetermined taught position range, the automatic operation controller outputs a next taught position as a target position.

7 Claims, 14 Drawing Sheets

5
19
54
RADIOCOMMU-NICATION UNIT
50
AUTOMATIC OPERATION CONTROLLER
414
TEACHING OPERATION UNIT
111~114
ANGLE SENSORS
PROPORTIONAL SOLENOID VALVES
51
52
CONTROL VALVES
53
ACTUATORS
CAB-MOUNTED UNIT
415
417
418
RADIOCOMMU-NICATION UNIT
COMMAND GENERATION SECTION
41
414
TEACHING OPERATION UNIT
REPRODUCTION OPERATION SECTION
411
START BUTTON
412
STOP BUTTON
416
CONTROL BOX

FIG. 4

TAUGHT POSITION DATA

| POSITION No. | (SWIVEL SUPERSTRUCTURE ANGLE, | BOOM ANGLE, | ARM ANGLE, | BUCKET ANGLE) |
|---|---|---|---|---|
| P1 | ( 10. | 20. | 30. | 10. ) |
| P2 | ( 10. | 30. | 40. | 50. ) |
| P3 | ( ..... | | ) | |
| Pn | ( ..... | | ) | |

FIG. 5

REPRODUCTION COMMANDS

```
L1
 V=70
 PAC=50
 MOVE P1
 V=90
 PAC=0
 MOVE P2
 V=50
 PAC=80
 MOVE P3
    :
    :
    :
 MOVE P4
 GOTO L1
```

FIG. 10

REGENERATION COMMANDS

```
L1:
 PAC    0
 V      70
 MOVE   P1
 MOVE   P2
 MOVE   P3
 WAIT   2
 MOVE   P4
 ...
 ...
 ...
 ...

 MOVE   Pn
 GOTO   L1
```

AUTOMATICALLY OPERATED SHOVEL AND STONE CRUSHING SYSTEM COMPRISING THE SAME

TECHNICAL FIELD

This invention relates to an automatically operated shovel, and more specifically to an automatically operated shovel permitting an automated adjustment of a digging path in accordance with a magnitude of digging resistance during excavation of a quarried material including rock and/or stone having high digging resistance, and also to a rock crushing system making use of the automatically operated shovel.

BACKGROUND ART

Power shovels are known as a representative example of construction machines for many years. In recent years, power shovels are designed to perform work by automated operation when the work consists of repetitions of a series of simple work ranging from digging to hauling. To permit automatic operation of a power shovel, however, there are a variety of problems which must be solved. For example, when a bucket comes into full contact with rock, stone or the like in the course of digging work by the power shovel and becomes no longer possible to perform a desired operation, a skilled operator infers such a situation and performs an evasive operation so that the work can be smoothly continued. To allow an automatically operated shovel to perform this, certain measures are needed.

As a conventional measure for the solution of such a problem during digging work, JP 61-9453 B discloses a technique that overload detection sensors are arranged to detect overloads applied to an arm and a bucket and, when an overload is detected, a boom is raised slightly to reduce the overload for the continuation of automated digging. On the other hand, JP 4-350220 A discloses a technique that, when at least one of detection values from pressure sensors attached to cylinders for actuating a boom, an arm and a bucket reaches a predetermined value or greater and at least one of operation speeds determined from angle sensors attached to the boom, arm and bucket becomes equal to or smaller than a predetermined value, both in the course of digging, an overload is determined and a digging path is shifted to avoid an obstacle to the digging work.

Automation of rock crushing work at quarries is also under way in recent years, and a technique on an automated rock crushing plant is disclosed in JP 9-195321 A. In this automated rock crushing plant, quarried rock heaved by a bulldozer is bucketed by a power shovel and hauled into a mobile crusher, where gravel is then produced. Further, the bulldozer operated by an operator is provided with a control device for automatically operating and controlling the power shovel and mobile crusher, and at a position remote from the power shovel, another control device is also arranged to automatically operate and control the power shovel and mobile crusher.

However, the technique of JP 61-9453 B requires the overload detection sensors in addition to position detecting sensors for detecting positions of individual articulations and moreover, involves a problem that a processing load for performing automated operation is significant. The technique of JP 4-350220 A, on the other hand, requires a variety of sensors, and also needs computation based on data detected by the sensors, resulting in applications of increased computation loads to the control device which the automatically operated shovel is provided with. Further, when the automatically operated shovel is operated slowly, its operation speed may become so low that it may be hardly distinguishable from a low speed at the time of overloading, leading to a potential problem of a false detection of an overload. Further, the pressure of each cylinder increases when the bucket comes into contact with rock, stone or the like. If the rock, stone or the like begins to move by a resulting shock, the pressure drops. This pressure drop may also lead to a potential problem of a false detection. In addition, with methods for determining an overload from such pressure sensors and operation speeds, it is practically difficult to determine the level of a pressure value and that of an operation speed both of which indicate an overload.

In the rock crushing plant disclosed in JP 9-195321 A, the power shovel is set such that quarried rock heaved by the bulldozer can be bucketed in an order stored in advance. To permit efficient bucketing of quarried rock by the power shovel, it is necessary to operate the bulldozer such that the quarried rock is heaved to an operating range of the power shovel. At this time, an operator on the bulldozer has to control the bulldozer by paying attention to the distance between the bulldozer and the power shovel so that the bulldozer can be kept out of contact with a front part of the power shovel which is performing the bucketing of quarried rock. Further, while the bucketing of quarried rock is performed by the power shovel, it is necessary to suspend the heaving operation of quarried rock to the operating range of the power shovel by the bulldozer in order to avoid any contact to the front part of the power shovel. A further problem also exists in that, when the amount of quarried rock becomes small within the operating range of the power shovel, the operation of the power shovel has to be suspended to heave quarried rock by the bulldozer. The rock crushing plant is therefore accompanied by problems that a rock crushing operation cannot be performed stably with good efficiency.

With the above-described various problems in view, an object of the present invention is to provide an automatically operated shovel which can avoid obstacles during digging by a simple method without needing a special system for the detection of an overloaded state during the digging and also to improve the efficiency of work in a rock crushing system making use of the automatically operated shovel.

DISCLOSURE OF THE INVENTION

To achieve the above-described object, the invention of claim 1 is characterized in that in an automatically operated shovel including a power shovel and an automatic operation controller arranged on the power shovel for making the power shovel reproduce a series of taught operations ranging from digging to hauling, the automatic operation controller is provided with a positioning determination means for determining whether or not the power shovel has reached within a positioning range predetermined based on corresponding one of positioning accuracies set for individual taught positions of the power shovel; and, when the power shovel is determined to have reached within the predetermined positioning range, the automatic operation controller outputs next one of the taught positions as a target position.

The invention of claim 2 is characterized in that in the invention of claim 1, during reproducing operations from an initiation of the digging to an end of the digging, the automatic operation controller outputs, subsequent to outputting one of the taught positions as a target position, a target position based on next one of the taught positions without performing a determination by the positioning determination means.

The invention of claim 3 is characterized in that in an automatically operated shovel including a power shovel provided with solenoid-operated directional control valves for operating hydraulic cylinders, which are adapted to actuate at least a boom, an arm and a bucket, and a hydraulic motor for driving a swivel superstructure and also with angle detector for detecting angles between the swivel superstructure and the boom, between the boom and the arm and between the arm and the bucket, respectively, a taught position output means for successively reading and outputting taught position data which have been taught and stored, a servo preprocessing means for being inputted with the taught position data and outputting target position data with position data interpolated between the taught position data to allow the power shovel to operate smoothly, and a servo control means for being inputted with the target position data and outputting control signals to the solenoid-operated directional control valves to control the power shovel to a target position, characterized in that the automatic operation controller is provided with a positioning determination means for determining whether or not the power shovel has reached within a positioning range predetermined based on corresponding one of positioning accuracies set for individual taught positions of the power shovel; and, when the power shovel is determined to have reached within the predetermined positioning range, the automatic operation controller outputs target position data based on next taught position data from the servo preprocessing section to the servo control section.

The invention of claim 4 is characterized in that in the invention of claim 3, the automatic operation controller is provided with a computing means for computing positioning accuracies of the swivel superstructure, boom, arm and bucket, respectively, based on the corresponding one of the positioning accuracies set for the individual taught positions; and the positioning determination means determines whether or not the swivel superstructure, boom, arm and bucket have reached within their corresponding positioning ranges predetermined based on the positioning accuracies, respectively.

The invention of claim 5 is characterized in that in the invention of any one of claims 3 and 4, during reproducing operations from an initiation of digging to an end of the digging, the servo preprocessing section outputs, subsequent to outputting final target position data corresponding to the taught position data, target position data based on next taught position data without performing a determination by the positioning determination means.

The invention of claim 6 is characterized in that in the invention of any one of claim 1, claim 3 and claim 4, among the positioning accuracies set for the individual taught positions from an initiation of the digging to an end of the digging, the positioning accuracies at the taught positions other than a digging initiating position and a digging ending position are set lower than positioning accuracies at the digging initiating position and the digging ending position.

The invention of claim 7 is characterized in that in the invention of any one of claim 1, claim 3, claim 4 and claim 6, the positioning accuracies set for the individual taught positions in a digging operation are set lower than the positioning accuracies set for the individual taught positions in a hauling operation.

The invention of claim 8 is characterized in that in the invention of any one of claim 1 to claim 7, the positioning accuracies set for the individual taught positions can be set at will by an operating means arranged on the power shovel or at a position remote from the power shovel.

The invention of claim 9 is characterized in that in a method for automatically operating an automatically operated shovel to make a power shovel reproduce a series of taught operations ranging from digging to hauling, the method comprises the following steps: (1) commanding taught positions and reproducing operation speeds and positioning accuracies at the taught positions to make the power shovel reproduce the operations; (2) computing target positions interpolated between the taught positions and taught positions preceding the taught positions to smoothen the reproducing operation; (3) commanding the target positions in succession; (4) determining whether or not a final target position out of the target positions, said final target position corresponding to the taught position, has been commanded and, when the final target position is not determined to have been commanded, performing the third step until the final target position is commanded; (5) when the final target position is determined to have been commanded in the fourth step, determining whether or not the positioning accuracy at the taught position is not smaller than a predetermined value; (6) when the positioning accuracy is determined to be not smaller than the predetermined value in the fifth step, determining whether or not a current position has reached within a positioning range predetermined based on the positioning accuracy and, when the current position is not determined to have reached within the positioning range, repeating the determination until the current position is determined to have reached within the positioning range; and (7) when the positioning accuracy is not determined to be not smaller than the predetermined value in the fifth step or when the current position is determined to have reached within the positioning range in the sixth step, commanding a taught position, which is next to the taught position, and a reproducing operation speed and a positioning accuracy at the next taught position.

The method of claim 10 is characterized in that in an automatically operated shovel including a power shovel and an automatic operation controller arranged on the power shovel for making the power shovel reproduce a series of taught operations ranging from digging to hauling, the automatic operation controller is provided with a delay means such that after a predetermined time has elapsed since an output of taught positions as target position data during reproducing operations ranging from an initiation of digging to an end of the digging, the automatic operation controller outputs next target position data.

The invention of claim 11 is characterized in that in an automatically operated shovel including a power shovel provided with solenoid-operated directional control valves for operating hydraulic cylinders, which are adapted to actuate at least a boom, an arm and a bucket, and a hydraulic motor for driving a swivel superstructure and also with angle detectors for detecting angles between the swivel superstructure and the boom, between the boom and the arm and between the arm and the bucket, respectively, a target position output means for successively reading taught position data, which have been taught and stored, and outputting the same as target position data, a servo preprocessing means for being inputted with the target position data, outputting the target position data and also outputting interpolated target position data to allow the power shovel to operate smoothly, and a servo control means for being inputted with the respective target position data and outputting control signals to the solenoid-operated directional control valves to control the power shovel to a target position, the target position output means is provided with a delay means such that after a predetermined time has elapsed since an output of taught positions as target position data from the servo preprocessing means to the servo control section during reproducing operations ranging from an initiation of digging to an end of the digging, the target position output means outputs next target position data.

The invention of claim 12 is characterized in that in the invention of any one of claim 10 and claim 11, the predetermined time set by the delay means is set at a time in which at a time of a light load or no load, the power shovel reaches the target position of the target position data after the taught position is outputted as the target position data.

The invention of claim 13 is characterized in that in a rock crushing system for producing crushed stone, the rock crushing system is provided with a quarried rock accumulation site for accumulating quarried rock dumped downwardly from a carry-in level on which the quarried rock is carried in; an excavator for bucketing the quarried rock accumulated at the quarried rock accumulation site and hauling the same; and a crusher for crushing the quarried rock, which has been hauled from the excavator, into crushed stone.

The invention of claim 14 is characterized in that in rock crushing system for producing crushed stone, the rock crushing system is provided with a quarried rock transporting apparatus for transporting quarried rock; a quarried rock accumulation site for accumulating quarried rock dumped downwardly from a carry-in level on which the quarried rock is carried in by the quarried rock transporting apparatus; an excavator for bucketing the quarried rock accumulated at the quarried rock accumulation site and hauling the same; and a crusher for crushing the quarried rock, which has been hauled from the excavator, into crushed stone.

The invention of claim 15 is characterized in that in a rock crushing system for producing crushed stone, the rock crushing system is provided with a quarried rock transporting apparatus for transporting quarried rock; a quarried rock accumulation site for accumulating quarried rock dumped downwardly from a carry-in level on which the quarried rock is carried in by the quarried rock transporting apparatus; an excavator for automatically performing work to bucket the quarried rock, which has been accumulated at the quarried rock accumulation site, and to haul the same; a crusher for crushing the quarried rock, which has been hauled from the excavator, into crushed stone; and a remote operation system for performing remote operation and control of the automatic operation of the excavator.

The invention of claim 16 is characterized in that in the invention of any one of claim 13 to claim 15, a bottom surface of the quarried rock accumulation site is located below a level at which the excavator is installed.

The invention of claim 17 is characterized in that in the invention of any one of claim 13 to claim 15, a bottom surface of the quarried rock accumulation site is located at substantially the same level as a level at which the excavator is installed.

The invention of claim 18 is characterized in that in a quarried rock accumulation site for a rock crushing system for producing crushed stone, the quarried rock accumulation site is provided with a bottom on which quarried rock is accumulated; a first guide wall for guiding quarried rock, which has been dumped from a quarried rock transporting apparatus, onto the bottom; and a second guide wall for allowing quarried rock, which remains subsequent to bucketing of the quarried rock by an excavator for transferring the quarried rock to a crusher, to return onto the bottom.

The invention of claim 19 is characterized in that in the invention of claim 18, a surface of the bottom is located below a level at which the excavator is installed.

The invention of claim 20 is characterized in that in a quarried rock accumulation site for a rock crushing system for producing crushed stone, the quarried rock accumulation site is provided with a bottom on which quarried rock is accumulated; and a guide wall for guiding quarried rock, which has been dumped from a quarried rock transporting apparatus, onto the bottom.

The invention of claim 21 is characterized in that in a rock crushing process for producing crushed stone, the rock crushing process comprises the following steps: dumping quarried rock, which has been carried in by a quarried rock transporting apparatus, to a quarried rock accumulation site having a bottom surface below a level at which an excavator is installed; bucketing the quarried rock, which has been heaved at the quarried rock accumulation site, by an excavator and hauling the same to a crusher; and crushing the quarried rock by the crusher to produce crushed stone.

BRIEF DESCRIPTION OF THE DRAWINGS

FIG. 4 is an illustration showing one example of taught position data which can be stored in a taught position storage section depicted in FIG. 3.

FIG. 5 is an illustration showing one example of reproduction commands which can be stored in a reproduction command storage section depicted in FIG. 3.

FIG. 10 is an illustration showing one example of reproduction commands which can be stored in a reproduction command storage section 503 depicted in FIG. 9.

BEST MODES FOR CARRYING OUT THE INVENTION

Firstly, the first embodiment of the present invention will be described with reference to FIG. 1 through FIG. 8.

Figure 1:
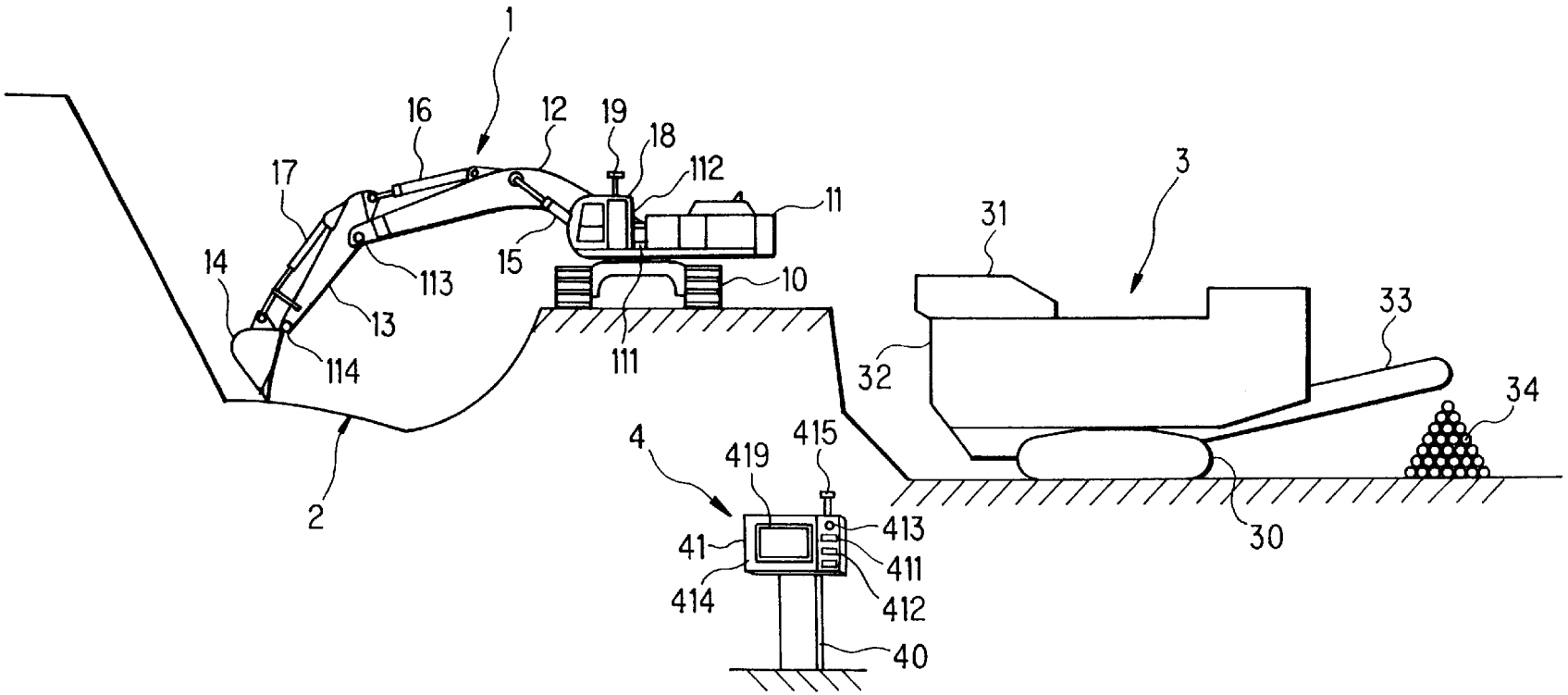
FIG. 1 is an illustration showing a main body of an automatically operated shovel according to a first embodiment of the present invention and one example of types of work by the automatically operated shovel.

FIG. 1 is a side view showing the automatically operated shovel according to each embodiment and an illustrative type of work by the automatically operated shove.

This drawing shows a main body 1 of the automatically operated shovel which digs quarried rock accumulated at a stockyard 2 and hauls it into a crusher 3 to be described subsequently herein, the crusher 3 for crushing quarried rock hauled from the automatically operated shovel main body 1, and a control box 4 arranged at a desired location suitable for performing reproducing operations by the automatically operated shovel main body 1.

The automatically operated shovel main body 1 is constructed of a travel base 10, a swivel superstructure 11 revolvably arranged on the travel base 10, a boom 12 pivotally arranged on the swivel superstructure 11, an arm 13 pivotally arranged on a free end of the boom 12, a bucket 14 pivotally arranged on a free end of the arm 13, cylinders 15,16,17 for pivotally operating the boom 12, arm 13 and bucket 14, respectively, a cab 18 arranged on the swivel superstructure 11, and an antenna 19 for performing transmission/reception of signals with the control box 4.

Further, the automatically operated shovel main body 1 is also provided with an angle sensor 111 for detecting a revolved angle of the swivel superstructure 11, an angle sensor 112 for detecting a pivoted angle of the boom 12 relative to the swivel superstructure 11, an angle sensor 113 for detecting a pivoted angle of the arm 13 relative to the boom 13, and an angle sensor 114 for detecting a pivoted angle of the bucket 14 relative to the arm 13.

The crusher 3, on the other hand, is constructed of a travel base 30, a hopper 31, a crushing portion 32 and a conveyor 33, and numeral 34 indicates stone crushed by the crusher 3.

The control box 4 is constructed of a stand 40 and a main unit 41 of a teaching/reproduction operation system, said main unit being fixed on the stand 40. The teaching/reproduction operation system main unit 41 is provided with a start button 411, a stop button 412, an emergency stop button 413, a teaching operation unit 414 arranged for mechanical and electrical connection with the teaching/reproduction operation system main unit 41 and operable upon teaching, a display 419 for displaying teaching results and the like, and an antenna 415 for performing transmission/reception of signals with the antenna 19 of the automatically operated shovel main body 1.

Figure 2:
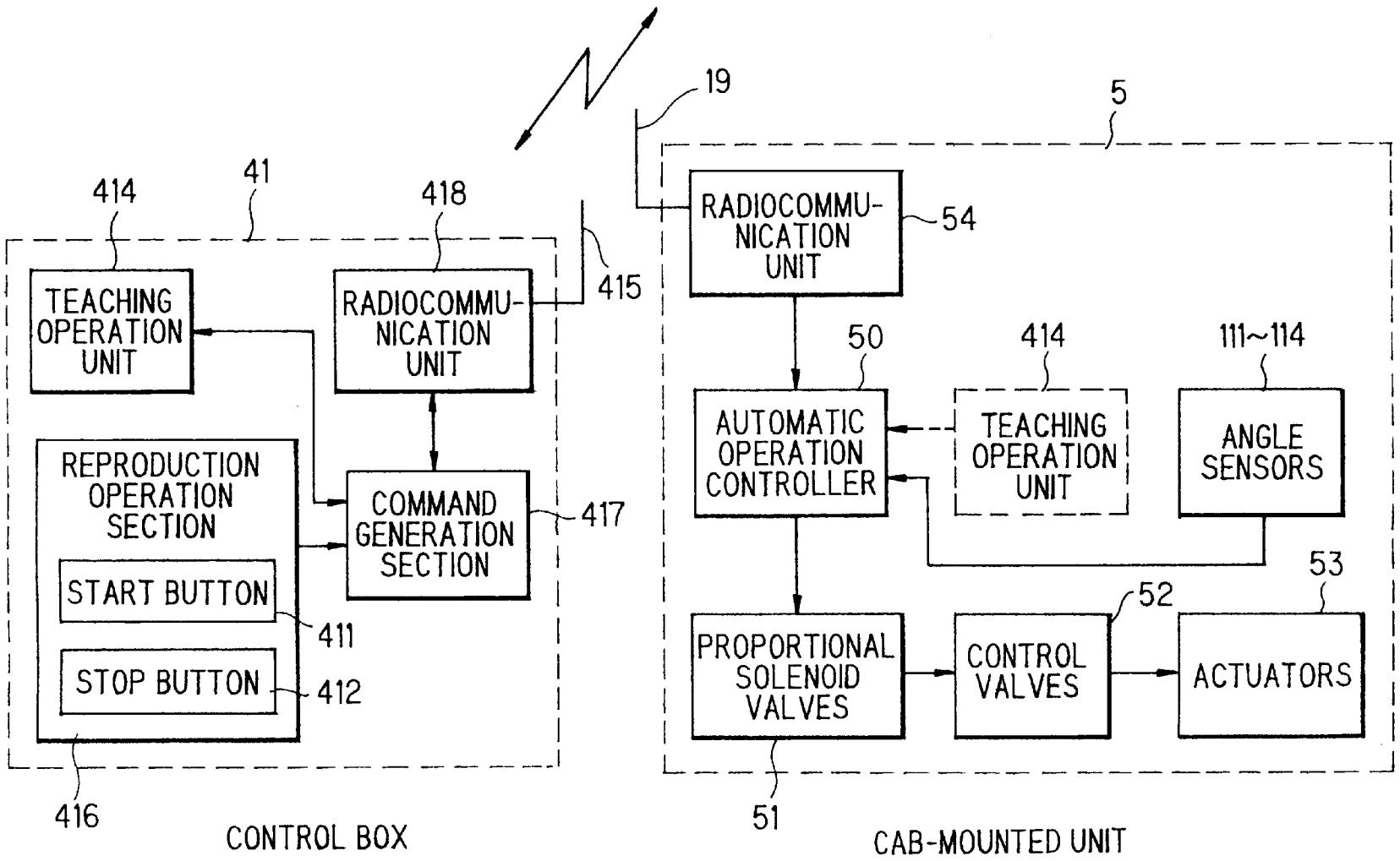
FIG. 2 is a block diagram showing a control system of a cab-mounted unit, which is mounted on the main body of the automatically operated shovel according to the first embodiment, and also a control system of a main unit of a teaching/reproduction system arranged in a control box.

FIG. 2 is a block diagram schematically illustrating the control system of the cab-mounted unit 5 mounted on the automatically operated shovel main body 1 and also the control system of the teaching/reproduction operation system main unit 41 in the control box 4, both of which are shown in FIG. 1.

This drawing shows a reproduction operation section 416 operable upon reproduction, a command generation section 417 for producing predetermined signals adapted to output signals, which have been outputted from the teaching operation unit 414 or the reproduction operation section 416, to an automatic operation controller 50 to be described subsequently herein, and radio communication units 418,54 for performing transmission/reception of signals between the teaching/reproduction operation system main unit 41 and the automatic operation controller 50. Incidentally, the command generation section 417 is constructed of an ordinary controller making use of a microcomputer, and has a function to generate command codes which correspond to inputted signals.

Designated at numeral 5 is the cab-mounted unit, which includes the automatic operation controller 50 constructed primarily of a computer and adapted to perform a variety of control for the automated operation of the automatically operated shovel, proportional solenoid valves 51 operable by drive currents outputted from the automatic operation controller 50, control valves 52 controlled by hydraulic signals outputted from the proportional solenoid valves 51 for controlling amounts of fluid or pressures of fluid to be fed to actuators, the actuators 53 such as cylinders 15,16, 17, . . . for operating individual articulations of the automatically operated shovel main body 1, and a teaching operation unit 414'. Elements indicated by the remaining reference numerals are the same as the corresponding elements of like reference numerals shown in FIG. 1.

In this drawing, a teaching operation is performed by an operation from the teaching operation unit 414' which is generally mounted in the cabin 18. The automatic operation controller 50, in accordance with its operation, is inputted with detection values from the individual angle sensors 111–114, perform computation, and, as will be described subsequently herein, stores the results of the computation as taught position data in a predetermined storage area. Further, in accordance with an operation from the teaching operation unit 414 or 414', a reproduction command which is to be used upon reproduction is set and stored in a predetermined memory area. Incidentally, this drawing shows the teaching operation unit 414 in a state that it has been detached from the teaching operation unit 414' in the cab 18 and is mounted on the teaching/reproduction operation system main unit 41.

Upon reproduction, the start button 411 is turned on from the reproduction operation section 416, whereby predetermined signals generated at the command generation section 417 are transmitted to the automatic operation controller 50 via the antennas 415,19, and processing for reproduction is initiated. When the processing for reproduction is initiated at the automatic operation controller 50, the stored taught position data are read, and drive currents are outputted to the proportional solenoid valves 51 to operate the swivel superstructure 11, boom 12, arm 13 and bucket 14 such that their positions are brought into conformity with the taught position data while comparing the taught position data with information on their current positions obtained from the angle sensors 111–114. The proportional solenoid valves 51 then control the corresponding actuators 53 via the control valves 52 such that reproducing operations by the automatically operated shovel main body 1 are performed.

Figure 3:
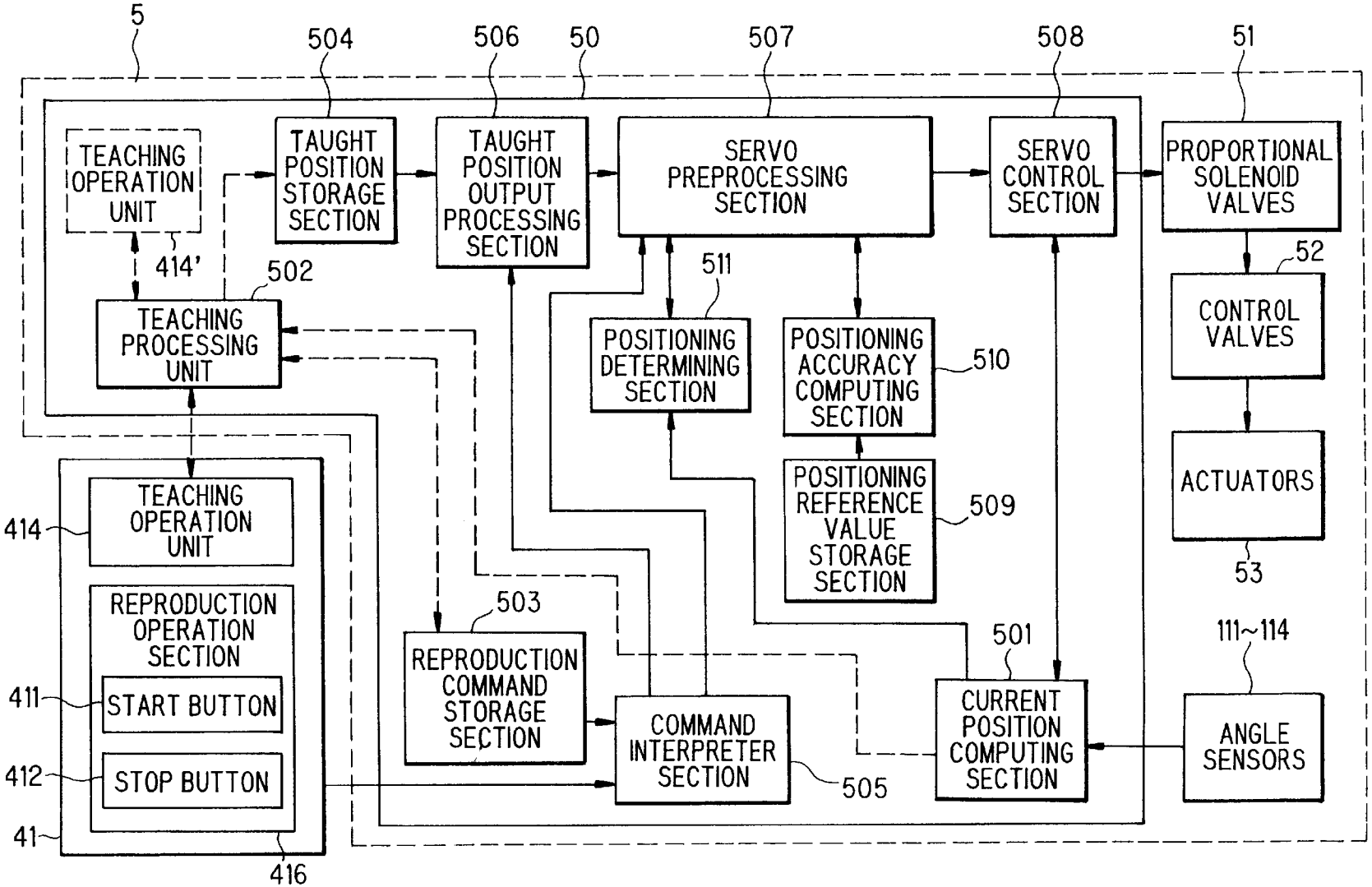
FIG. 3 is a block diagram showing in detail a functional construction of an automatic operation controller according to the first embodiment.

FIG. 3 is a block diagram which illustrates details of the functional construction of the embodiment of the automatic operation controller 50 shown in FIG. 2.

This drawing shows a current position computing section 501 for computing angle signals, which have been detected at the angle sensors 111–114, into current position data, a teaching processing section 502 for outputting a current position of the automatically operated shovel main body 1, which has been obtained from the current position computing section 501, as taught position data upon teaching by an operation from the teaching operation unit 414 or 414', a reproduction command storage section 503 where commands for instructing various operations upon reproduction, said operations having been set by the teaching processing section 502 in accordance with commands from the teaching operation unit 414 or 414', are stored, a taught position storage section 504 for storing taught position data outputted from the teaching processing section 502, a command interpreter section 505 which, when actuated by an actuation signal from the reproduction operation section 416, successively interprets reproduction commands stored in the reproduction command storage section 503 and instructs an output of predetermined taught position data from the taught position storage section 504, a taught position output processing section 506 for output-processing the taught position data from the taught position storage section 504 in accordance with an instruction from the command interpreter section 505, a servo preprocessing section 507 for preparing and outputting target position data, which interpolate between the taught position data, on the basis of the taught position data outputted from the taught position output processing section 506, in other words, performing interpolating computation at certain constant intervals between a given start point (a current position or a taught position) and an end point (a taught position) to prepare time series data and successively outputting the time series data as target angle values to a servo control section 508 so that the automatically operated shovel main body 1 is allowed to smoothly operate between the individual taught positions, and the servo control section 508 for comparing interpolated target position data, which have been outputted from the servo preprocessing section 507, with the current position data outputted from the current position computing section 501 and then outputting drive currents such that the individual articulations of the automatically operated shovel main body 1 can be controlled to predetermined positions, respectively.

Also shown are a positioning reference value storage section 509 where positioning reference values to be used as references for setting positioning accuracies for the individual articulations are stored, a positioning accuracy computing section 510 for being controlled by instructions from the servo preprocessing section 507 such that positioning accuracies of the individual articulations at each taught position are computed and determined based on the corresponding reference values stored in the positioning reference value storage section 509 and the positioning accuracy set for the corresponding taught position, and a positioning determining section 511 for being controlled by instructions from the servo preprocessing section 507 to determine whether or not the individual articulations have reached within their positioning ranges at the respective taught positions. Elements indicated by the remaining reference numerals are the same as the corresponding elements of like reference numerals shown in FIG. 2.

FIG. 4 is a diagram showing one example of taught positions which can be stored in the taught position storage section 504 depicted in FIG. 3.

In this drawing, P1–Pn correspond to taught positions and also correspond to reproduction command labels P1–Pn to be described subsequently herein, and values of swivel superstructure angle, boom angle, arm angle and bucket angle, said values being supposed to be taken by the corresponding elements of the automatically operated shovel at the respective taught positions, have been set.

FIG. 5 is a diagram showing one example of reproduction commands, which relate to this embodiment and can be stored in the reproduction command storage section 503.

In this drawing, L1 represents a row label rather than a command. V indicates a command for instructing a moving speed, and the greater its value, the higher the moving speed. PAC (positional accuracy) is a command which instructs a positioning accuracy for the movement. As it is not easy to move the automatically operated shovel to a predetermined taught position, PAC is used to determine that the automatically operated shovel has reached the taught position when it has reached within such a range of positioning accuracy as indicated by its value. As this value becomes greater, more accurate tracking to a taught position is required. Each MOVE is a command for instructing a movement to an instructed taught position, and P1–Pn are labels indicating angle information of the individual angles by the MOVE commands. For example, MOVE P1 indicates that the automatically operated shovel should move to the position No. P1 shown in FIG. 4 out of the taught positions stored in the taught position storage section 504. GOTO L1 is a command which instructs an initiation of execution from the row label L1 again.

With reference to FIG. 3, a description will next be made of operations of the automatically operated shovel according to this embodiment.

A teaching operation is performed from the teaching operation unit 414 or 414'. In general, the teaching operation unit 414' is mounted in the cabin 18 of the automatically operated shovel main body 1, and a teaching operation is hence performed from the cabin.

When the teaching operation unit 414' is mounted in the cabin 18 and a teaching operation is performed, its instructions are inputted to the teaching processing section 502. At the teaching processing section 502, current position data are inputted from the current position computing section 501, whereby reproduction commands and taught position data, both of which correspond to individual taught positions, are produced. The reproduction commands and taught position data so produced are stored in the reproduction command storage section 503 and the taught position storage section 504, respectively.

When the start button 411 is turned on, the command interpreter section 505, in response to a start command, successively reads the reproduction commands stored in the reproduction command storage section 503 so that a reproducing operation is performed. When the reproduction command is a MOVE command, corresponding parameters are outputted from the taught position storage section 504 to the taught position output processing section 506 and are then transferred to the servo preprocessing section 507.

The servo preprocessing section 507 performs interpolating computation of angles such that the individual articulations will operate at target speeds given from the command interpreter section 505, and target angle values are outputted to the servo control section 508. At the servo control section 508, conventional feedback control is conducted based on the current position data computed at the current position computing section 501 and the target angle values outputted from the servo preprocessing section 507, whereby drive currents for operating the proportional solenoid valves 51 are outputted. By these drive currents the control valves 52 are controlled to feed pressure fluid at predetermined rates to the actuators 53, so that the individual articulations of the automatically operated shovel main body 1 are driven.

On the other hand, the positioning accuracy computing section 510 computes positioning accuracies for the individual articulations, said positioning accuracies corresponding to the positioning accuracies given for each taught position, on the basis of the corresponding reference values stored in the positioning reference value storage section 509.

When the interpolating computation at the servo preprocessing section 507 reaches the final target position (for example, P2 in the case of MOVE P2) and the final target position data are outputted to the servo control section 508, the positioning determining section 511 determines by an instruction from the servo preprocessing section 507 whether or not the current positions of the individual articulations have reached within their corresponding positioning ranges set based on the positioning accuracies computed for the individual articulations by the positioning accuracy computing section 510. If the individual articulations are not found to have reached within the corresponding positioning ranges as a result of the determination, the servo preprocessing section 507 continues to output the above-described final target position to the servo control section 508. If the individual articulations are found to have reached within the corresponding positioning ranges, the servo preprocessing section 507 ceases the output of the final target position, and performs interpolating computation between the taught position (P2) and a next taught position (P3) outputted from the taught position output processing section 506 to continue the automated operations.

An operation of the automatically operated shovel main body 1 during digging will next be described with reference to FIG. 6 to FIG. 7.

Figure 6:
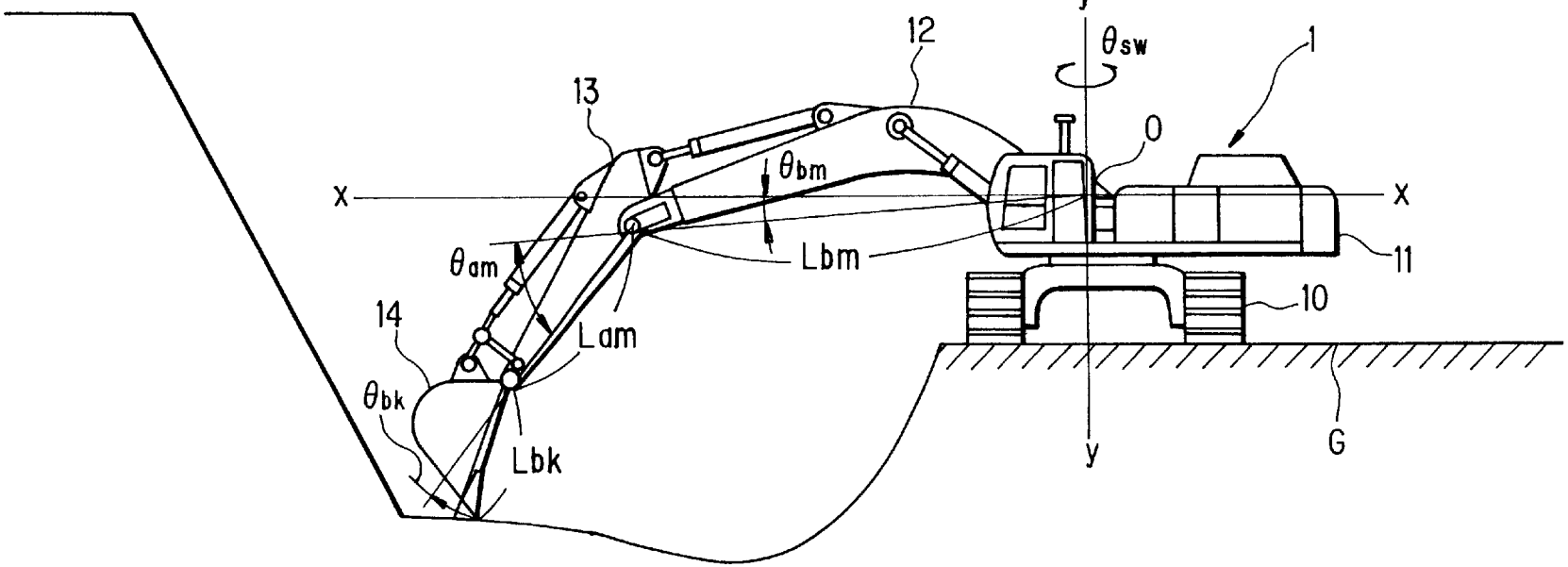
FIG. 6 is an illustration showing dimensions and angles of individual articulations, with a pivot of a boom of the main body of the automatically operated shovel according to the first embodiment being set as an origin O.

FIG. 6 is an illustration showing the dimensions and angles of the individual articulations of the automatically operated shovel main body 1, with the pivot of the boom 12 being set as an origin O, and illustrates a ground level G for the automatically operated shovel main body 1, a boom length Lbm, an arm length Lam, a bucket length Lbk, an angle θsw which the swivel superstructure 11 forms with the travel base 10, an angle θbm formed between a horizontal axis X and the boom 12, θam formed between the boom 12 and the arm 13, and an angle θbk between the arm 13 and the bucket 14.

Figure 7:
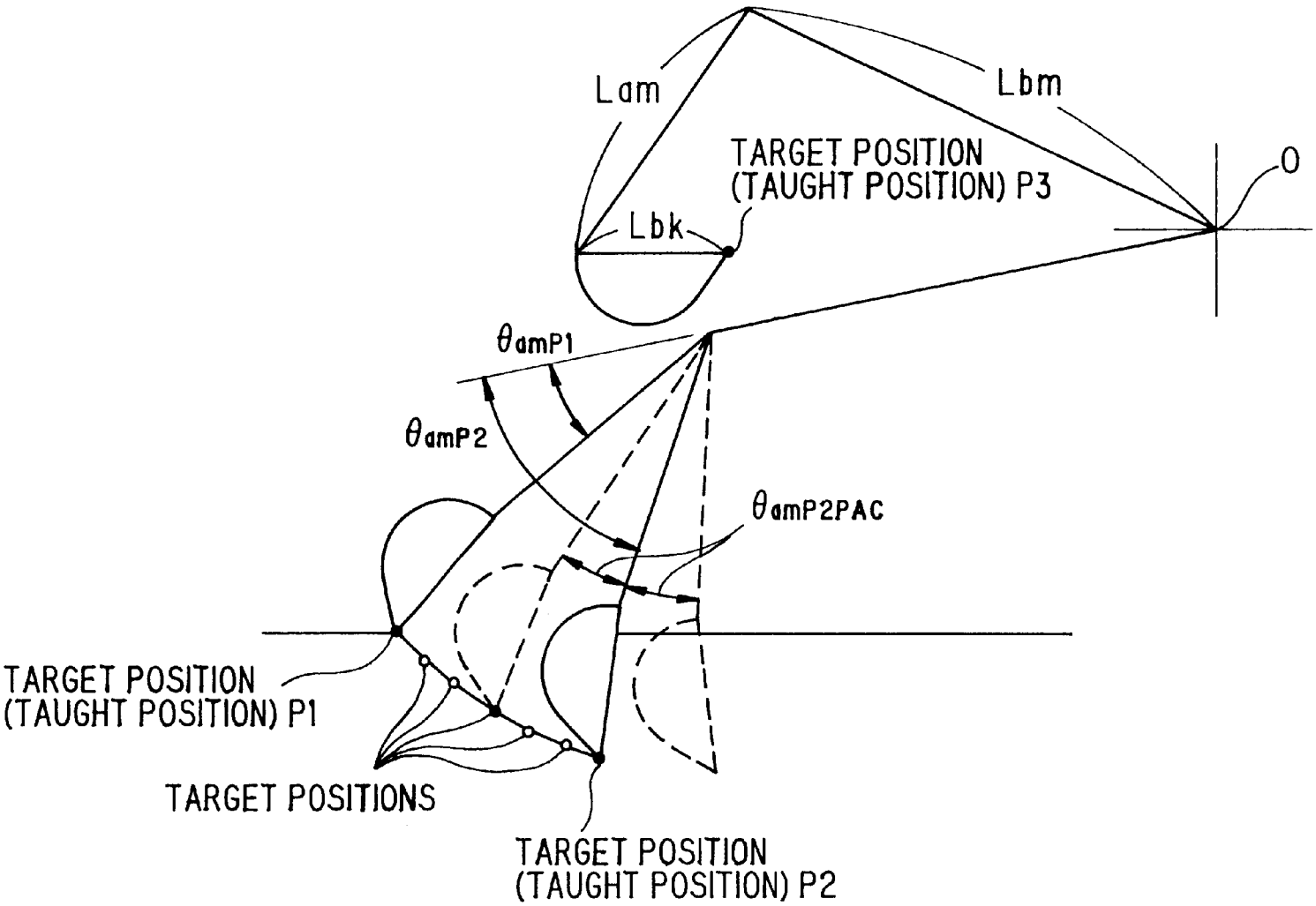
FIG. 7 is an illustration showing a digging start position P1, an intermediate digging position P2 and a digging end position P3 for the main body of the automatically operated shovel according to the first embodiment.

FIG. 7 is an illustration showing, relative to the origin O as a center, the digging start position Pi, the intermediate digging position P2 and the digging end position P3 for the automatically operated shovel main body, and illustrates an arm angle θam P1 at P1, an arm angle θamP2 at P2, and a positioning range θamP2PAC for the arm at P2.

The operation in the reproduction is performed in the order of P1→P2→P3, and the operation of P1→P2 is designed to consist solely of arm crowding.

Firstly, upon performing the operation from P1 to P2, the following commands stored in the reproduction command storage section 503 are outputted to the servo preprocessing section 507 by the command interpreter section 505 shown in FIG. 3.

V=90 (1)

PAC=0 (2)

MOVE P2 (3)

Here, V in the formula (1) is a command which indicates a speed as described above. In this case, interpolating computation is conducted at the servo preprocessing section 507 so that the arm is operated at a speed of 90% based on a maximum speed of the arm. Further, PAC in the formula (2) is a command which indicates a positioning accuracy at an intermediate digging position P2 as described above. Positioning accuracies for the individual articulations of the swivel superstructure, boom, arm and bucket are computed at the positioning accuracy computing section 510 on the basis of the positioning accuracy values PAC at the individual taught positions P1,P2,P3, . . . and the positioning reference values θswPAC,θbmPAC,θamPAC,θbkPAC for the individual articulations of the swivel superstructure, boom, arm and bucket stored in the positioning reference value storage section 509.

Now, when PAC=100, for example, the positioning accuracy θamP2PAC for the arm at P2 is calculated as follows:

$$\theta amP2PAC = \{1 + (100 - PAC)/10\}\theta amPAC = \theta amPAC \quad (4)$$

When PAC=50, $$\theta amP2PAC = \{1 + (100 - PAC)/10\}\theta amPAC = 6\theta amPAC \quad (5)$$

When PAC=0, $$\theta amP2PAC = \{1 + (100 - PAC)/10\}\theta amPAC = 11\theta amPAC \quad (6)$$

In this embodiment, however, when PAC=0 and when the interpolating computation at the servo preprocessing section 507 has reached the final target position (P2), no determination is made at the positioning determining section 511, that is, no determination is made as to which position between P1 and P2 the current position of the corresponding articulation is located and the next interpolating computation between P2 and P3 is immediately conducted.

In this embodiment, the positioning accuracy for each articulation was determined by using its corresponding positioning accuracy and positioning reference value in accordance with the relationships of the above formulas (4)–(6). However, it can also be set as desired without using these relational expressions. Incidentally, the positioning accuracies θbmP2PAC,θamP2PAC,θbkP2PAC for the remaining articulations can be determined in a similar manner as θamP2PAC.

When the final target positions are outputted from the servo preprocessing section 507 to the servo control section 508, a determination is generally made at the positioning determining section 511 on the basis of the thus-computed positioning accuracies for the respective articulations as to whether or not the automatically operated shovel main body has reached the positioning range. Namely, even after final target values have been outputted, the individual articulations of the boom, arm, bucket and the like are still tracking with delays relative to their final target positions. Concerning the arm, for example, when PAC=50, it is therefore determined in view of the formula (5) whether or not the articulation of the arm has reached within the positioning range of θamP2±6θamP2PAC. If the positioning range is not determined to have been reached, the serve preprocessing section 507 continues to output the final target position to the servo control section 508 so that the individual articulations of the automatically operated shovel main body 1 continue to move toward the final target positions, respectively. If the individual articulations of the automatically operated shovel main body 1 is determined to have reached within the above-described positioning ranges, the output of the final target positions is ceased, and interpolating computation between the intermediate digging position P2 to the next digging end position P3 is initiated to output interpolated new target values, whereby the individual articulations begin to move toward the new positions, respectively.

In this embodiment, the positioning accuracy for the intermediate digging position P2 is set, for example, at PAC=0 in view of the possibility that, when moving from the digging start position P1 toward the intermediate digging position P2, substantial digging resistance may be encountered due to rock or stone and the intermediate digging position P2 may become hardly reachable. As a result, when the servo preprocessing section 507 outputs a final target position P2, the next interpolating computation is immediately performed from P2 toward P3. As the individual articulations are operated to start moving toward the interpolated new target values, respectively, it is possible to evade such a situation that as a result of over-eagerly tracking the target position P2, resistance by an obstacle such as rock or stone may be encountered and the digging may be interrupted. The operations of P1→P2→P2 can therefore be smoothly performed without interruption.

In this embodiment, PAC=80 is set for the digging end position P3 to designate the crowded position of the bucket with a high accuracy so that falling of dug material can be avoided. Further, if precise positioning is needed as in the case of hauling dug material above the hopper of the crusher, positioning is feasible with a sufficient accuracy by increasing the value of the positioning accuracy PAC and making the positioning range narrower.

Figure 8:
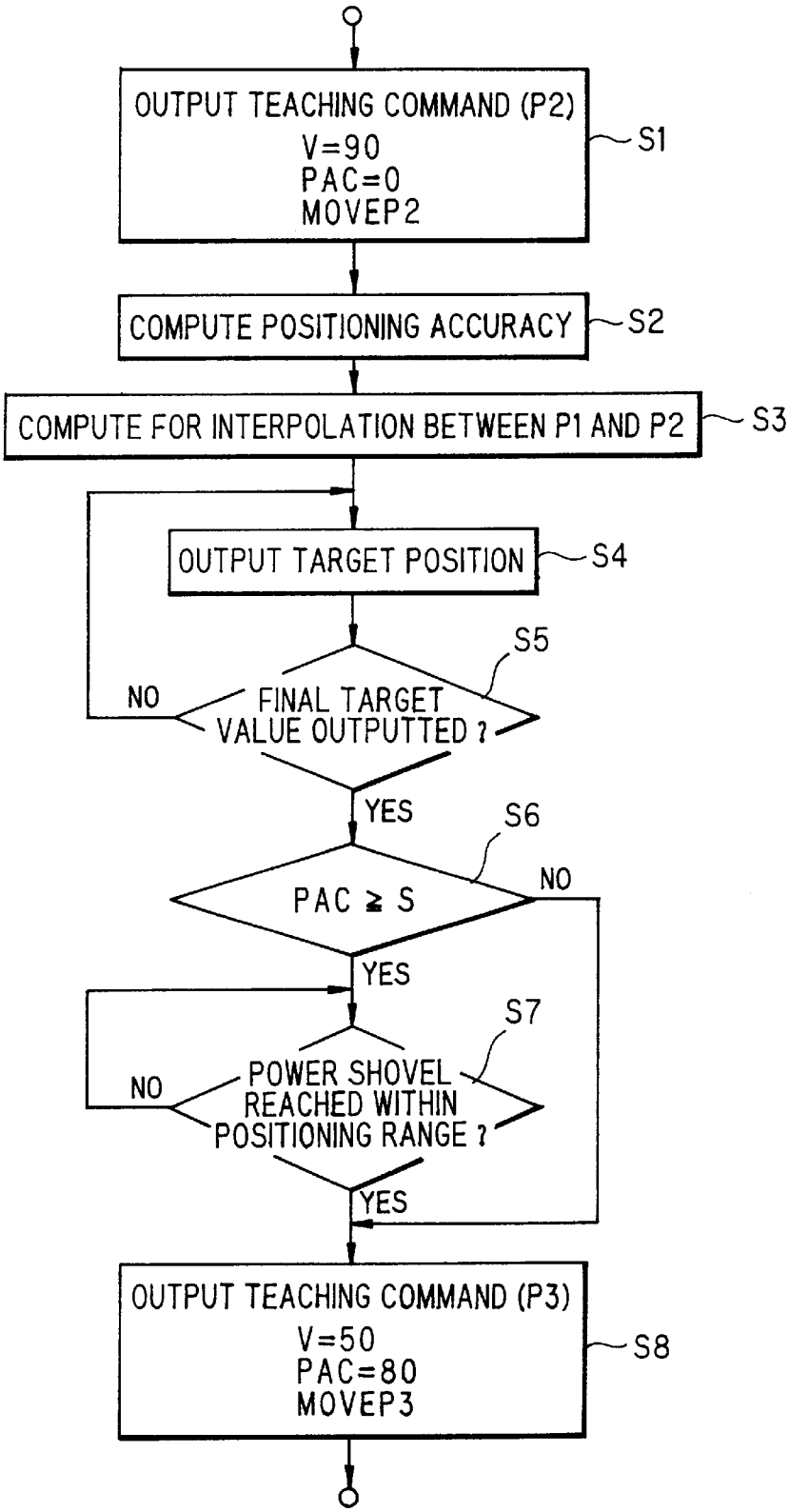
FIG. 8 is a flow chart showing procedures of a reproducing operation by the automatically operated shovel according to the first embodiment.

Now, a description will be made of procedures of reproducing operations at individual positions (in this illustration, from the taught position P1 to the taught position P3) by the automatic operation controller 50 with reference to the flow chart depicted in FIG. 8.

If each articulation is determined at the positioning determining section 511 to have reached within its corresponding positioning range subsequent to an output of the final target position P1 from the servo preprocessing section 507 although this determination is not shown in the flow chart, reproduction commands for the taught position P2, V=90, PAC=0 ad MOVE P2 are firstly outputted to the reproduction command storage section 503 in step 1. In step 2, a positioning accuracy for each articulation is next computed at the positioning accuracy computing section 510. In step 3, interpolating computation is then conducted between P1 and P2 at the servo preprocessing section 507, and in step 4, target positions obtained by the interpolating computation are outputted to the servo control section 508 so that each articulation is caused to operate under servo control. It is then determined in step 5 whether or not the final target position (P2) out of the target positions outputted as a result of the interpolating computation in step 3 has been outputted. Here, if the interpolated target positions are not determined to have reached the final target position, the routine returns to step 4, and interpolated target positions are outputted to the servo control section 508 until the final target position (P2) is outputted as an interpolated target position. When the final target position is outputted to the servo control section 508, it is determined in step 6 whether or not the positioning accuracy PAC for the taught position (P2) is greater than a predetermined value S set as desired. If the positioning accuracy PAC is greater than the predetermined value S, a determination is made in step 7 on the basis of the positioning accuracy for each articulation computed in step 2 as to whether or not the articulation has reached within its positioning range predetermined for the final target position (P2). Described specifically, it is determined whether or not the individual articulations have reached within the ranges $\theta swP2 \pm \theta swP2PAC$, $\theta bmP2 \pm \theta bmP2PAC$, $\theta amP2 \pm \theta amP2PAC$ and $\theta bkP2 \pm \theta bkP2PAC$, respectively. If the individual articulations are not determined to have reached within their corresponding predetermined positioning ranges for the final target position (P2), the processing of step 7 is repeated until the individual articulations reach within their corresponding predetermined positioning ranges for the final target position (P2). When the individual-articulations are determined to have reached within their corresponding positioning ranges for the final target position (P2), the routine advances to step 8. If the positioning accuracy PAC is smaller than the predetermined value S in step 6, for example, when PAC=0 is set as shown in step 1, the determination in step 7 as to whether or not the respective positioning ranges are reached is not performed, and the routine advances to step S8 so that reproduction commands for the next taught position P3 are immediately outputted. After that, processing similar to the processing procedures of step 1 onwards is repeated to continue the reproducing operation.

As has been described above, according to this embodiment, the positioning accuracy for each articulation of the automatically operated shovel at the digging intermediate position P2 is set low (PAC=0) and, when the servo preprocessing section 507 outputs the final target position (P2) as a result of interpolating computation, each articulation is immediately servo-controlled toward a new target position interpolated between the intermediate digging position P2 and the digging end position P3 without being servo-controlled toward the final target value P2 no matter at which position between the digging start position P1 and the intermediate digging position P2 the tracking articulation is located. Owing to this, even if there is an obstacle having large digging resistance, such as rock or stone, between the digging start position P1 and the intermediate digging position P2, the direction from the intermediate digging position P2 toward the digging end position P3 can be diverted from the direction from the digging start position P1 toward the intermediate digging position P2, thereby making it possible to allow the automatically operated shovel main body 1 to automatically evade the obstacle and to continue the reproducing operation without interruption.

According to this embodiment, each tracking articulation is located at a position between the digging start position P1 and the intermediate digging position P2 when the final target position (P2) is outputted by the servo preprocessing section 507 as a result of interpolating computation. When material to be dug between the digging start position P1 and the intermediate digging position P2 is one having small digging resistance, a delay of each articulation is small for the small digging resistance. The current position of each articulation is therefore located at a position close to the final target position (P2). It is therefore possible to perform excavation with a high digging accuracy by following the taught positions P1,P2,P3, . . . .

The second embodiment of the present invention will next be described with reference to FIG. 9 and to FIG. 11.

Figure 9:
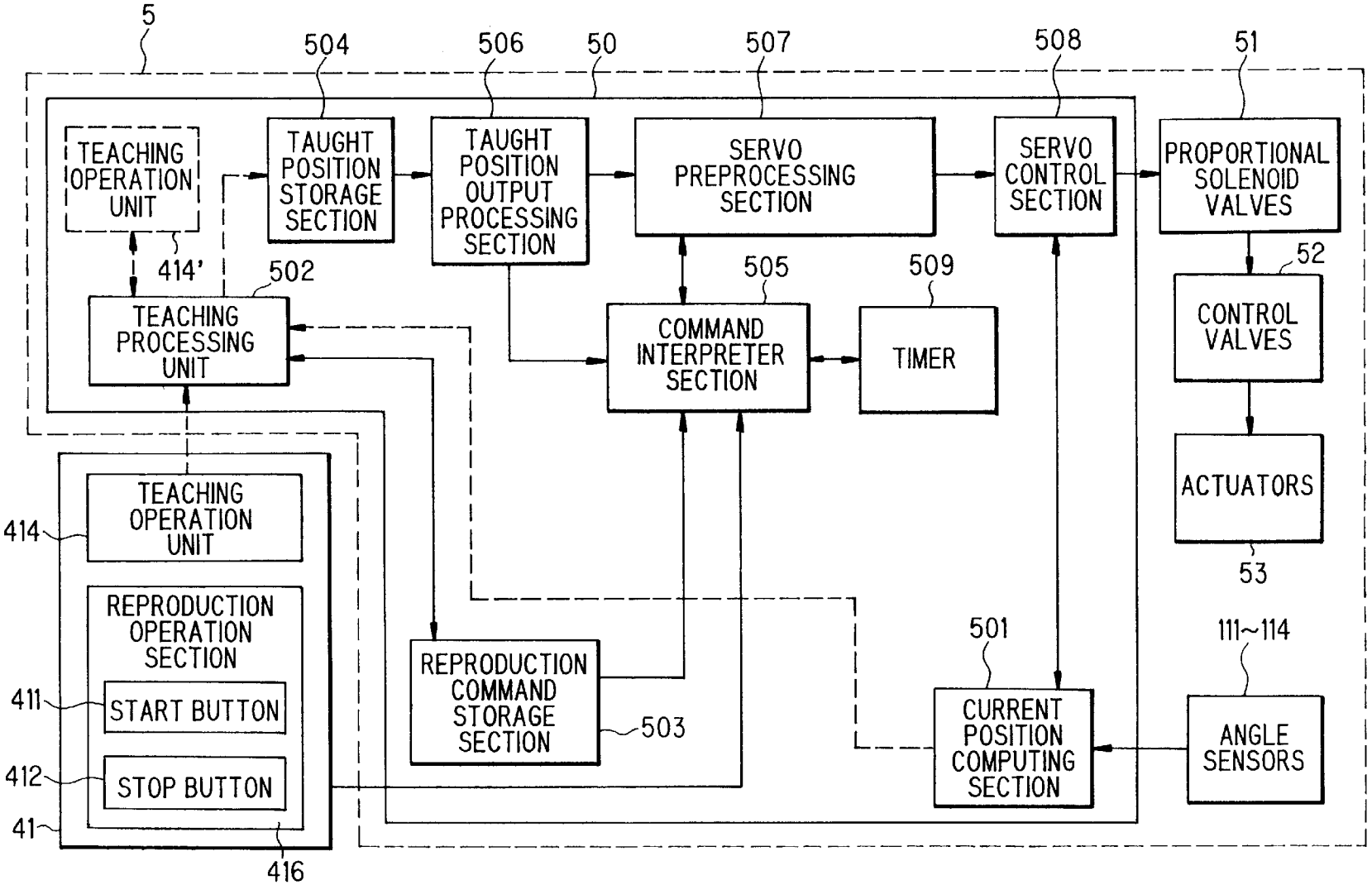
FIG. 9 is a block diagram showing details of a functional construction of an automatic operation controller according to a second embodiment of the present invention.

FIG. 9 is a block diagram showing details of the functional construction of this embodiment of the automatic operation controller 50 shown in FIG. 3.

Numeral 512 indicates a timer for performing counting for a predetermined time upon receipt of an instruction from the command interpreter section 505 and sending a response to the command interpreter section 505. The remaining elements are the same as those of like reference numerals shown in FIG. 3 and their description is therefore omitted herein.

FIG. 10 is an illustration showing one example of reproduction commands according to this embodiment, which can be stored in the reproduction command storage section 503 depicted in FIG. 3.

In this drawing, PAC (positional accuracy) is a command which designates a positioning accuracy of a movement as already described. In the drawing, PAC=0 is set to make the positioning accuracy small so that digging work proceeds smoothly, thereby making it possible to complete the movement even if there is a substantial difference between a target position and a current position.

WAIT is a command that instructs a standby of a predetermined time. After taught position data P3 are outputted from the serve preprocessing section 507 to the servo command section 508, the output information is transmitted to the command interpreter section 505. If a WAIT command has been set, the command interpreter section 505 outputs to the timer 512 a preset time designated by the WAIT command and, after the preset time is elapsed, the timer 512 outputs a completion answer to the command interpreter section 505. When the completion answer is outputted, the command interpreter section 505 makes the servo preprocessing section 507 output target position data, which interpolate between the taught target position data P3 and the taught target position data P4, from the servo preprocessing section 507 to the servo control section 508 to perform servo control such that the automatically operated shovel main body 1 moves toward the target position data P4. The preset time is set at a time which runs from an output of the taught target position data from the servo preprocessing section 507 in a light load state or a no load state until a practical reach of the automatically operated shovel main body 1 at a target position of the target position data. The remaining commands are the same as the corresponding ones shown in FIG. 5, and their description is therefore omitted herein.

An evasive operation of the automatically operated shovel main body 1 according to this embodiment from an obstacle such as rock or stone will next be described with reference to FIG. 11.

Figure 11:
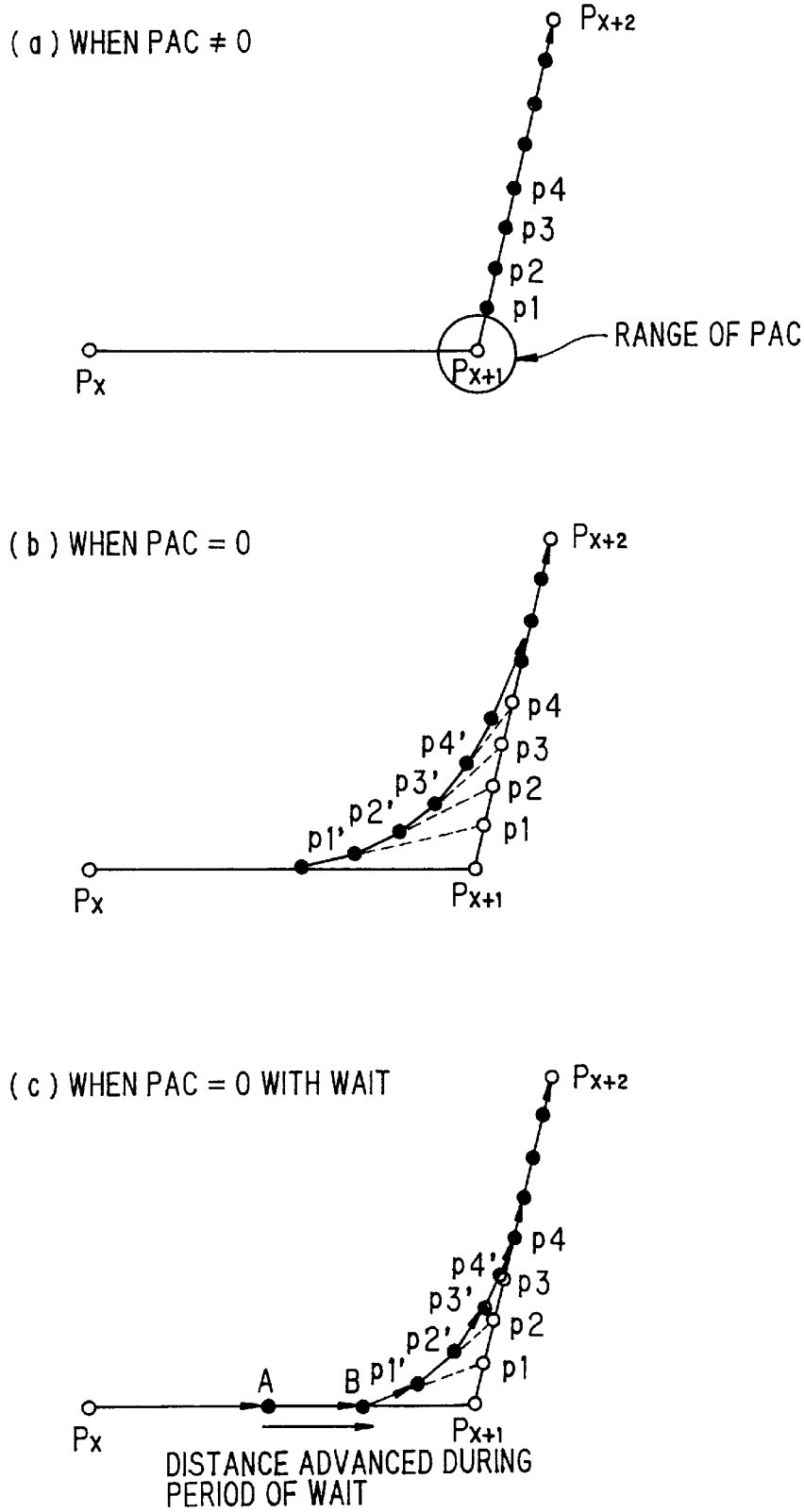
FIG. 11 is an illustration showing an evasive method of an automatically operated shovel according to the second embodiment from an obstacle such as rock or stone.

FIG. 11(*a*) is an illustration showing target positions of a free end of a bucket and its path when PAC≠0, FIG. 11(*b*) is an illustration showing target positions of the free end of the bucket and its path when PAC=0, and FIG. 11(*c*) is an illustration showing target positions of the free end of the bucket and its path when PAC=0 and there is a WAIT command. In these illustrations, Px, Px+1 and Px+2 indicate target positions based on taught position data stored in the taught position storage section 504, p1,p2,p3, . . . designate interpolated target positions calculated based on the taught positions, and p1',p2',p3', . . . denote positions through which the free end of the bucket actually passed.

Firstly, the servo preprocessing section 507 obtains and holds current position data Px via the angle sensors 111–114, the current position computing section 501 and the servo control section 508. Next, taught position data Px+1 is read as a target from the taught position output processing section 506, and a difference C between both of these data, for example, a difference of ⅛ is calculated. The position data Px+difference C/8 is outputted as position data to the servo control section 508. The servo preprocessing section 507 then outputs the position data Px+a difference 2C/8 to the servo control section 508. Similar processing is repeated thereafter, whereby the position data Px+a difference C (=taught position data Px+1) is outputted to the servo control section 508.

In actual servo control, however, the free end of the bucket, for example, tracks with a delay even when a move command is outputted as a target from the servo control section 508 to the proportional solenoid valve 51. When PAC is set at a predetermined value other than 0 as shown in FIG. 11(*a*), servo control is performed toward the target position Px+1 when the current position of the free end of the bucket is still located at a position between Px and Px+1, even if the target position Px+1 is outputted from the servo control section 508. When the free end of the bucket moves and reaches within a circle shown in FIG. 11(*a*) and corresponding to the predetermined value of PAC, Px+1 is no longer used as a target position and servo control is performed toward the calculated interpolated target position p1 as a target.

In this case, reproduction can be performed with good accuracy by setting the value of PAC at an appropriate value. Even when the bucket comes into contact with an obstacle such as rock or stone and becomes no longer movable in a situation that at the time of an output of the target position Px+1, the current position of the bucket is still at a position between Px and Px+1 and has not reached within the circle in FIG. 11(*a*), an attempt may however be made with a view to causing the bucket to move further toward the target position Px+1, and the bucket may stop there and may fail to evade the obstacle.

When the value of PAC is set at 0 as shown in FIG. 11(*b*), interpolating processing is initiated between the taught target position Px+1 and the next target position Px+2, at a time point that the target position Px+1 has been out-putted from the servo control section 508, even if the current position of the free end of the bucket is still located at any position between Px and Px+1, whereby interpolated target positions p1,p2, . . . are successively set. Accordingly, the free end of the bucket is servo-controlled toward the interpolated target positions p1,p2, . . . without moving toward the target position Px+1. When PAC is set at 0, the free end of the bucket, different from the case of FIG. 11(*a*), is not servo-controlled toward the target position Px+1 until it reaches within a predetermined circle determined by the value of PAC. If the bucket comes into contact with an obstacle such as rock or stone and becomes hardly movable, the target positions are changed to p1,p2, . . . and the free end of the bucket is hence allowed to pass through points p1',p2', p3', . . . , thereby making it possible to evade the obstacle such as rock or stone.

Owing to the setting of PAC at 0 in the above-described case, the obstacle such as rock or stone can be evaded during excavation as described above. As is shown in the drawing, however, the free end of the bucket does not pass through the target position Px+1 and then through the interpolated target positions p1,p2, . . . although it should basically pass through them. It is therefore impossible to make the bucket perform work with good accuracy.

According to this embodiment, commands of PAC=0 and WAIT are therefore set when there is a potential problem of striking against an obstacle such as rock or stone. As a result, if the current position of the free end of the bucket is still located at any position (position A) between Px and Px+1 at a time point that the target position Px+1 has been outputted as a target from the servo control section 508, the target position Px+1 is retained as a target point for a predetermined time set by WAIT without initiating interpolating processing between the target position Px+1 and the next target position Px+2 to set a next target position. During this time, the bucket moves toward the target position Px+1 and, after the predetermined time has elapsed (position B), interpolating processing between the target position Px+1 and the next target position Px+2 is initiated to set interpolated target positions p1,p2, . . . . From this time point, the free end of the bucket is servo-controlled toward the successively interpolated target positions p1,p2, . . . without moving toward the target position Px+1.

As has been described above, according to this embodiment, if the free end of the bucket is still located at any position between Px and Px+1 at the time point that the taught target position Px+1 has been outputted, interpolating processing is initiated after awaiting a predetermined time without immediately initiating interpolating processing of the next target position, and during this time, the bucket is servo-controlled such that it moves toward the target position Px+1. If there is no obstacle such as rock or stone, it is possible to make the bucket perform work by allowing the free end of the bucket to pass through a position located close to the target position Px+1, thereby making it possible to perform a reproducing operation with good accuracy. Even if the bucket comes into contact with an obstacle such as rock or stone and becomes no longer movable, the target position is changed from the target position Px+1 to the interpolated target positions p1,p2, . . . when the predetermined time has elapsed. It is therefore possible to evade the obstacle such as rock or stone.

The rock crushing system according to the third embodiment of the present invention will next be described with reference to FIG. 12 through FIG. 15.

Figure 12:
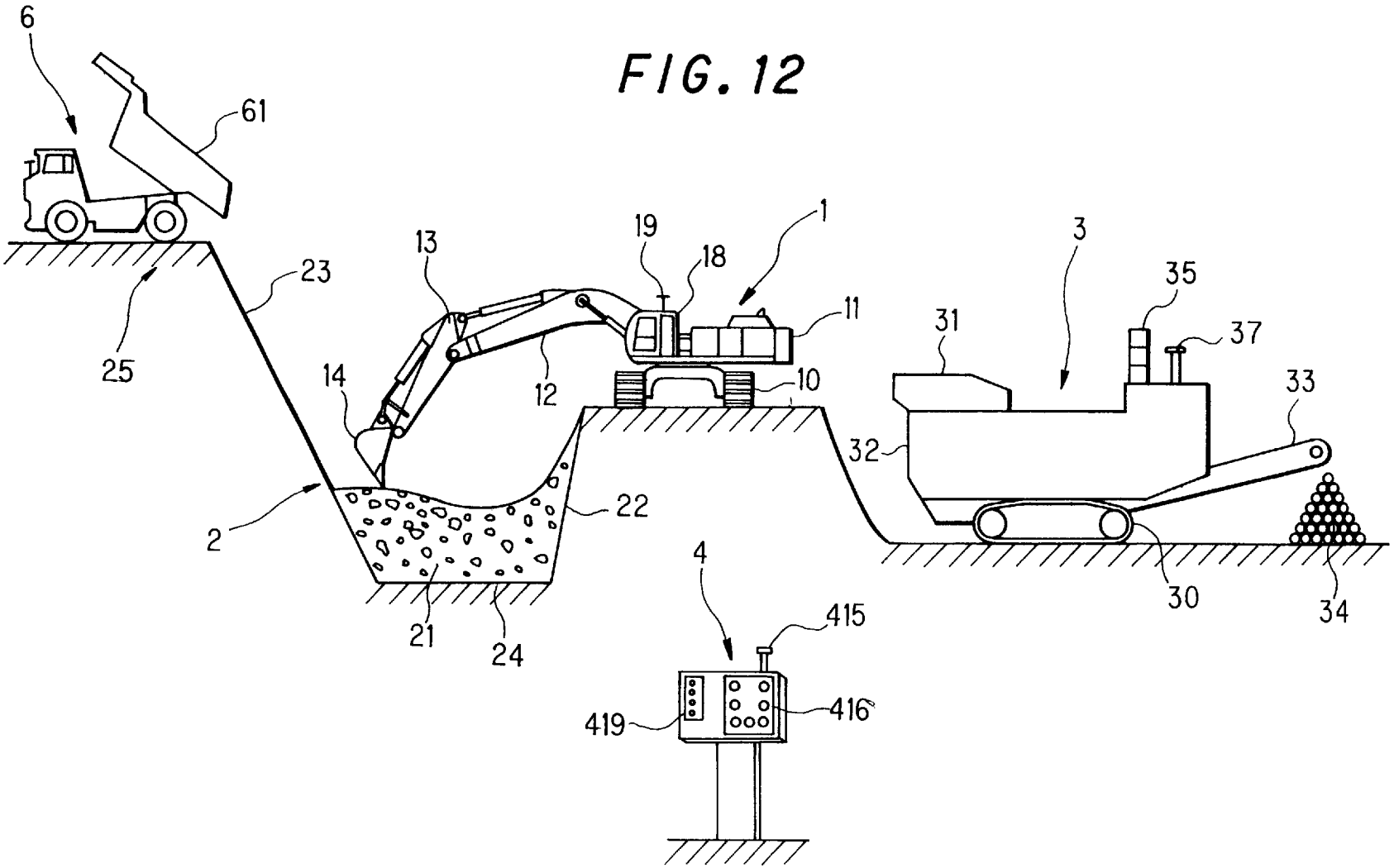
FIG. 12 is an illustration showing an overall construction of a rock crushing system according to a third embodiment of the present invention and a type of work by the rock crushing system.

FIG. 12 is an illustration showing the overall construction of the rock crushing system according to the third embodiment of the present invention and the type of work by the rock crushing system.

In this drawing, numeral 1 indicates a main body of such an automatically operated shovel of the backhoe type as those employed in the first and second embodiments.

Designated at numeral 2 is a stockyard for temporarily storing quarried rock 21, and the stockyard 2 is arranged in the vicinity of a site at which the automatically operated shovel main body 1 is installed. The stockyard 2 is constructed of a first guide wall 23 formed with an inclination on a side away from the installation site of the automatically operated shovel main body 1, a second guide wall 22 formed at an inclination on a side of the installation site of the automatically operated shovel main body 1, and a bottom 24 formed between the first guide wall 23 and the second guide wall 22, and the bottom 24 is formed below a level of the installation site of the automatically operated shovel main body 1. The first guide wall 23 and the second guide wall 22 are formed such that they flare upwardly from the bottom 24, and the first guide wall 23 extends to a level higher than the level of the installation site of the automatically operated shovel main body 1. Further, the inclination of the first guide wall 23 may desirably be set at an angle such that quarried rock 21 dumped from an extended upper portion of the first guide wall, namely, from a dumping platform 25 for quarried rock 21 is accumulated on the bottom 24. On the other hand, the inclination of the second guide wall 22 may preferably be set, from the standpoint of the efficiency of bucketing work of quarried rock, at an angle such that quarried rock still remaining subsequent to bucketing by the bucket 14 of the automatically operated shovel main body 1 is allowed to return to the bottom 24.

Numeral 6 indicates an extended portion of the first guide wall 23, said extended portion forming the stockyard 2, in other words, designates a quarried rock transporting apparatus, such as a truck, which advances onto the dumping platform for quarried rock 21. The quarried rock transporting apparatus 6 is provided with a vessel 61 which is adapted to carry quarried rock obtained by quarrying a ground, hill or mountain at another location. The quarried rock transporting apparatus 6 is driven by an operator on the apparatus, and at the dumping platform 25, dumps quarried rock, which is loaded on the vessel 61, to the stockyard 2 by tilting the vessel 61.

Designated at numeral 3 is a crusher, which is arranged in the vicinity of the automatically operated shovel main body 1 and is provided with an abnormality detecting section 35 for detecting an abnormal state of the crusher 3 and outputting an abnormal state detection signal and also with an antenna 37. The remaining elements are the same as those designated at like reference numerals in FIG. 1.

Figure 13:
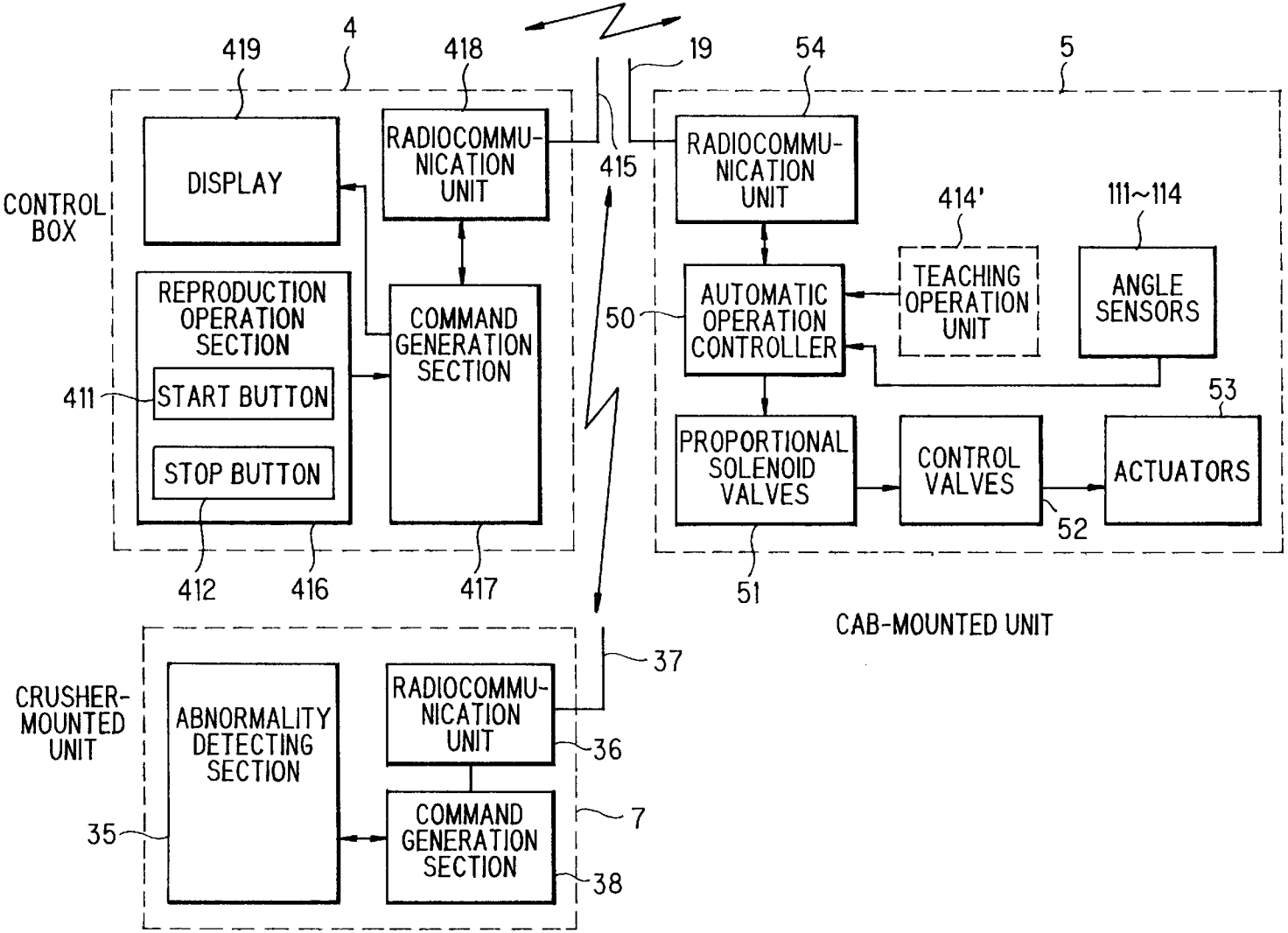
FIG. 13 is a block diagram schematically showing a control system of the rock crushing system according to the third embodiment.

FIG. 13 is a block diagram schematically showing the control system of the rock crushing system according to this embodiment. The remaining elements are the same as those indicated at like reference numerals in FIG. 2.

Designated at numeral 419 is a display, which displays various states of the rock crushing system such as an abnormal operation state, a normal operation state, and taught operation states of the automatically operated shovel.

There are also shown a crusher-mounted unit 7, a radio communication unit 36 for transmitting an abnormal state detection signal to the control box 4, and a command generation section 38 for instructing transmission of an abnormality signal when an abnormal state is detected.

An operation of the rock crushing system according to this embodiment will next be described with reference to FIG. 12 and FIG. 13.

As is illustrated in FIG. 12, quarried rock is dumped to the stockyard 2 from the quarried rock transporting apparatus 6. Dumping of quarried rock from the quarried rock transporting apparatus 6 is effected at such a time that it is not coincided with bucketing operations of quarried rock 21 by the bucket 14 of the automatically operated shovel main body 1. Quarried rock dumped from the quarried rock transporting apparatus 6 falls down along the first guide wall 23 forming the stockyard 2, and is accumulated on the bottom 24. Upon receipt of a start command from the control box 4, the automatically operated shovel main body 1 reproduces a taught operation in accordance with the taught operation which has been stored in advance. Described specifically, the quarried rock 21 in the stockyard 2 is bucketed by the bucket 14, the swivel superstructure 11 is then caused to revolve with the quarried rock held in the bucket such that the bucket 14 is positioned above the hopper 31 of the crusher 3, the bucket 14 is next pivoted to haul the quarried rock from the bucket 14 into the hopper 31, and the swivel superstructure 11 is again caused to revolve such that the bucket 14 is moved back to the stockyard 2 to bucket the quarried rock 21. This operation is repeated.

The quarried rock 21 hauled into the hopper 31 of the crusher 3 is crushed and then released as crushed stone 34 by the conveyor 33. The crushed stone 34 is carried away by a conveying apparatus which is arranged additionally.

In the production work of crushed stone, the quarried rock 21 fallen down from the bucket 14 and the quarried rock 21 drawn to the side of the automatically operated shovel main body 1, both when the quarried rock 21 in the stockyard 2 was bucketed by the bucket 14 of the automatically operated shovel main body 1, are allowed to return toward the bottom 24 by the second guide wall 22 forming the stockyard 2. As a result, the quarried rock 21 does not heave at a particular area on the bottom 24 of the stockyard 2, thereby making it possible to improve the efficiency of bucketing work by the buck et 14 of the automatically operated shovel main body 1.

As the dumping point of the quarried rock 21 into the stockyard 2 i s set at a position remote from the installation site of the automatically operated shovel main body 1, it is no longer necessary to worry about any contact between the quarried rock transporting apparatus 6 and the automatically operated shovel main body 1. As a consequence, the quarried rock 21 can be supplied safely and efficiently into the stockyard 2.

If any abnormality takes place on the crusher 3, a detection signal is transmitted form the abnormality detection section 35 to the control box 4. Accordingly, the control box 4 displays this abnormal state at the display 419 and also transmits a stop command to the crusher 4. As a consequence, abnormality of the crusher 3 can also be centrally monitored and controlled so that the production of crushed stone can be conducted stably and efficiently.

Figure 14:
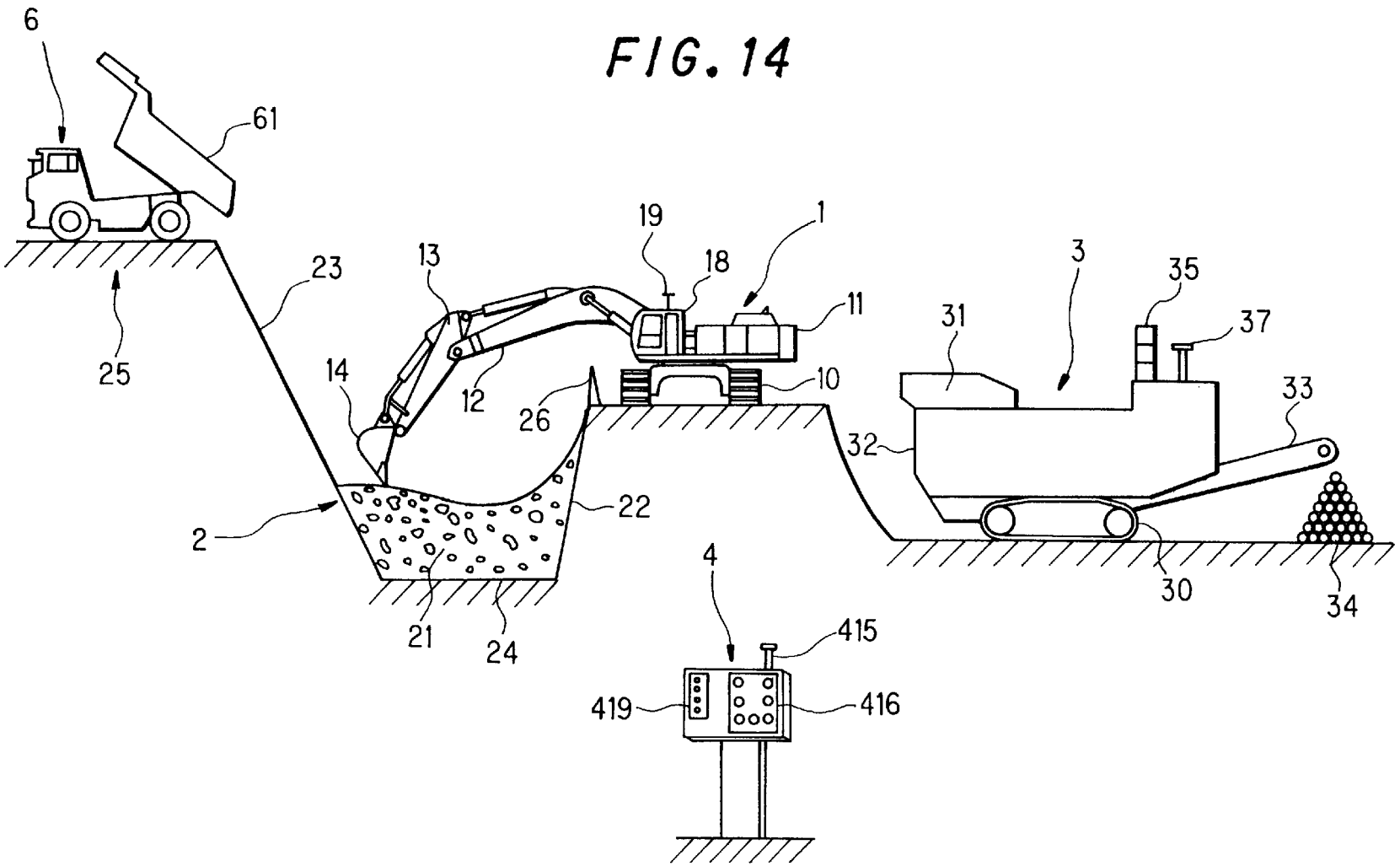
FIG. 14 is an illustration showing an overall construction of another rock crushing system according to the third embodiment and a type of work by the rock crushing system.

FIG. 14 is an illustration showing the overall construction of another rock crushing system according to this embodiment, which is different from that shown in FIG. 12, and also the type of work by the rock crushing system.

In this drawing, elements designated at like reference numerals as those shown in FIG. 12 indicate like reference elements.

This rock crushing system is different from that shown in FIG. 12 in that near an intersection between the second guide wall 22 forming the stockyard 2 and the installation surface of the automatically operated shovel main body 1, a quarried rock stopper 26 is arranged to prevent the quarried rock 21 from moving toward the installation surface of the automatically operated shovel main body 1.

According to this rock crushing system, the bucket 14 of the automatically operated shovel main body 1 is taught to operate such that it moves by evading the quarried rock stopper 26. Further, this rock crushing system is effective when the stockyard 2 cannot be arranged at a level sufficiently lower than the installation surface of the automatically operated shovel main body 1, and can bring about similar advantageous effects as the preceding rock crushing system.

In each of the above-described rock crushing systems, the second guide wall 22 forming the stockyard 2 was formed with an inclination. However, this second guide wall may be formed substantially upright.

Figure 15:
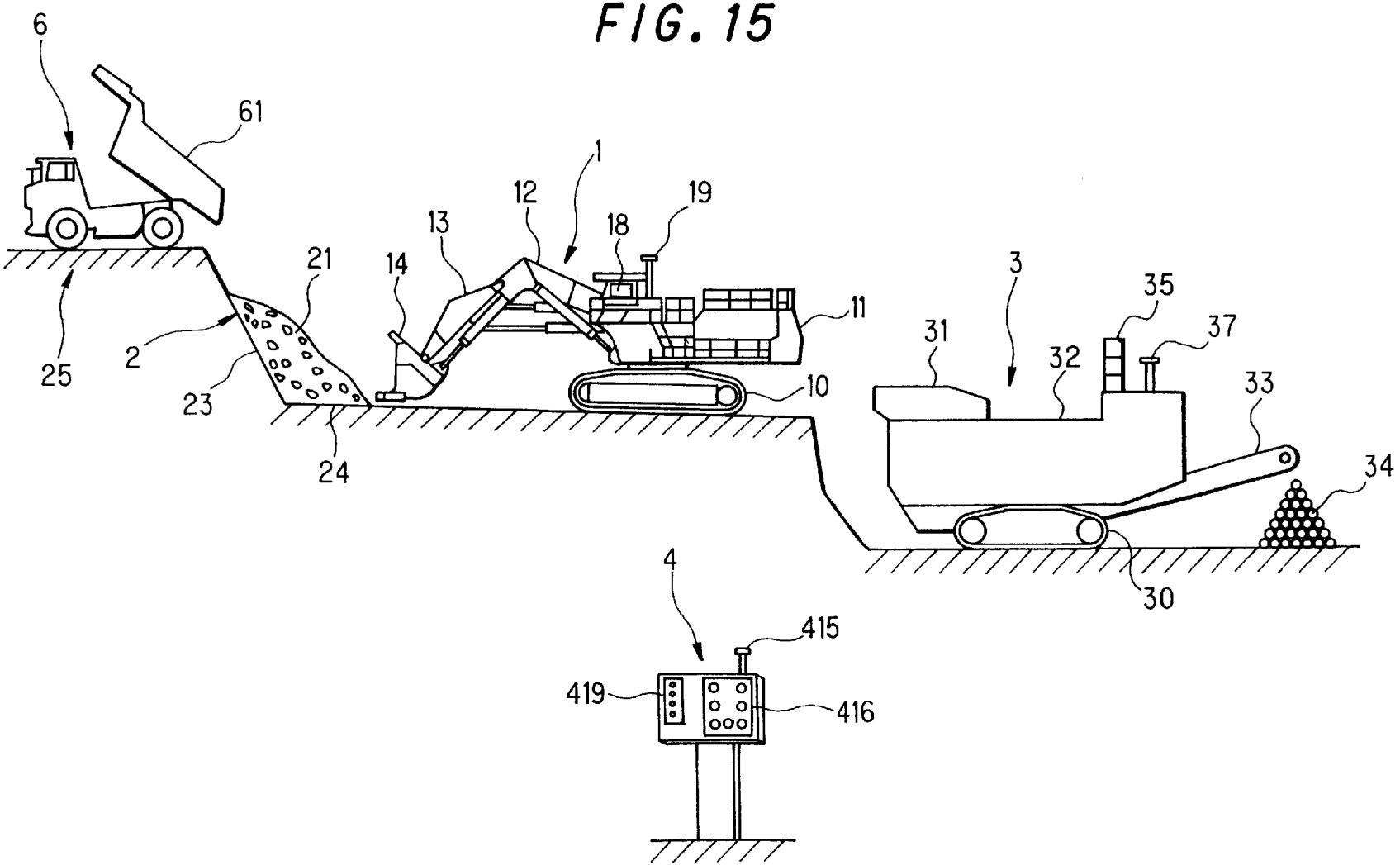
FIG. 15 is an illustration showing an overall construction of a further rock crushing system according to the third embodiment and a type of work by the rock crushing system.

FIG. 15 is an illustration showing the overall construction of the further rock crushing system according to this embodiment, which is different from those shown in FIG. 12 and FIG. 14, and also the type of work by the rock crushing system.

In this drawing, elements designated at like reference numerals as those shown in FIG. 12 indicate like elements.

This rock crushing system is different from the rock crushing systems shown in FIG. 12 and FIG. 14 in that as the automatically operated shovel main body 1, one of the loading shovel type is used and also in that the surface of a bottom 24 forming a stockyard 2 and the installation surface of the automatically operated shovel main body 1 are set at substantially the same level.

As the automatically operated shovel main body 1 is of the loading shovel type in this rock crushing system, quarried rock 21 can be bucketed efficiently despite the arrangement of the surface of the bottom 24 of the stockyard 2 and the installation surface of the automatically operated shovel main body 1 at substantially the same level.

In each of the above-described rock crushing systems, the crusher 3 is arranged at a level lower than the installation surface of the automatically operated shovel main body 1. The crusher 3 may however be arranged at substantially the same level as the installation surface of the automatically operated shovel main body 1.

Capability of Exploitation in Industry

As has been described above, the automatically operated shovel according to the present invention is constructed such that the automatic controller is provided with the positioning determining means for determining an reach of the power shovel within a taught position range predetermined based on a positioning accuracy set for each taught position of the power shovel and, when the power shovel is determined to have reached within the above-described predetermined taught position range, a next taught position is outputted as a target position. For each taught position, a positioning accuracy is therefore set as desired. The digging accuracy can therefore been controlled depending on each working position of digging or dumping, thereby making it possible to perform an automated operation with high accuracy and high working efficiency. Further, the automatic operation controller in the automatically operated shovel according to this invention is designed to output a target position based on a next taught position without performing any determination by the positioning determining means after a taught position is outputted as a target position during a reproducing operation from an initiation of digging to an end of the digging. It is therefore possible to automatically change a digging path depending on the magnitude of digging resistance during the digging. This makes it possible to prevent an interruption of digging due to striking against an obstacle having high digging resistance such as rock or stone and hence to perform efficient digging.

Further, the automatic operation controller in the automatically operated shovel according to the present invention is provided with the delay means for making the automatic operation controller output next target position data subsequent to an elapse of a predetermined time after a taught point is outputted as target position data during a reproducing operation from an initiation of digging to an end of the digging. If there is no obstacle such as rock or stone, it is possible to make the bucket to pass through a position located close to the taught target position and hence to perform the digging work with good accuracy. Even if the bucket comes into contact with an obstacle such as rock or stone and becomes no longer movable, the target position to which the bucket is supposed to move is changed to a next target position so that the obstacle can be evaded. The digging work can therefore be continued without needing a time-consuming evasive operation. Different from the conventional art, the automatically operated shovel according to this invention does not require a variety of sensors to exhibit the above-described respective advantageous effects, and further, the processing load of computation to the automatic operation controller is low.

In addition, the rock crushing system according to the present invention is designed to accumulate quarried rock at a stockyard and to bucket the thus-accumulated quarried rock by the excavator. Rock crushing work can therefore be performed stably and efficiently. As the rock crushing system according to this invention also makes it possible to accumulate quarried rock such that it can be bucketed by the excavator, no work is needed for heaving quarried rock, leading to an improvement in the efficiency of rock crushing work. Further, the rock crushing system according to the present invention forms crushed stone through the crusher by repeating an operation that quarried rock is accumulated at the stockyard and the accumulated quarried rock is bucketed by the excavator and is then hauled into the crusher. It is therefore possible to improve the efficiency of the rock crushing work.

What is claimed is:

1. A rock crushing system for producing crushed stone, wherein said rock crushing system is provided with a quarried rock transporting apparatus for transporting quarried rock; a quarried rock accumulation site for accumulating quarried rock dumped downwardly from a carry-in level on which said quarried rock is carried in by said quarried rock transporting apparatus; an excavator arranged at a level lower than said carry-in level for automatically performing work to bucket said quarried rock, which has been accumulated at said quarried rock accumulation site, and to dump the same; a crusher for crushing said quarried rock, which has been dumped from said excavator, into crushed stone; and a remote operation system for performing remote operation and control of said automatic operation of said excavator.

2. A rock crushing system according to claim 1, wherein a bottom surface of said quarried rock accumulation site is located below the level at which said excavator is installed.

3. A rock crushing system according to claim 1, wherein said excavator is of a type that buckets forwards from said excavator; and a bottom surface of said quarried rock accumulation site is located at substantially the same level as the level at which said excavator is installed.

4. A rock crushing system according to claim 3, wherein said quarried rock accumulation site is provided with a bottom on which quarried rock is accumulated; an inclined first guide wall for guiding quarried rock, which has been dumped from a quarried rock transporting apparatus, onto said bottom.

5. A rock crushing system according to claim 1 wherein said quarried rock accumulation site is provided with a bottom on which quarried rock is accumulated; an inclined first guide wall for guiding quarried rock, which has been dumped from a quarried rock transporting apparatus, onto said bottom; and a second guide wall for allowing quarried rock, which remains subsequent to bucketing of said quarried rock by an excavator for transferring said quarried rock to a crusher, to return onto said bottom.

6. A rock crushing system according to claim 5, wherein a surface of said bottom is located below the level at which said excavator is installed.

7. A rock crushing process for producing crushed stone, wherein said rock crushing process comprises the following steps: dumping quarried rock, which has been carried in by a quarried rock transporting apparatus, from a carry-in level to a quarried rock accumulation site having a bottom surface below a level, which is lower than said carry-in level, at which an excavator is installed for automatically performing work to bucket said quarried rock; bucketing said quarried rock, which has been heaved at said quarried rock accumulation site, by said excavator and dumping the quarried rock to a crusher; and crushing said quarried rock by said crusher to produce crushed stone.

* * * * *